US006991740B2

(12) United States Patent
Ward

(10) Patent No.: US 6,991,740 B2
(45) **Date of Patent: *Jan. 31, 2006**

(54) METHOD FOR REDUCING REMOVAL FORCES FOR CMP PADS

(75) Inventor: Trent T. Ward, Kuna, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/852,547

(22) Filed: May 24, 2004

(65) Prior Publication Data

US 2005/0000941 A1 Jan. 6, 2005

Related U.S. Application Data

(63) Continuation of application No. 10/160,528, filed on May 31, 2002, now Pat. No. 6,814,834, which is a continuation of application No. 09/478,692, filed on Jan. 6, 2000, now Pat. No. 6,398,905, which is a continuation of application No. 09/124,329, filed on Jul. 29, 1998, now Pat. No. 6,036,586.

(51) Int. Cl.

| | |
|---|---|
| ***B44C 1/22*** | (2006.01) |
| ***C03C 15/00*** | (2006.01) |
| ***C03C 25/68*** | (2006.01) |
| ***C23F 1/00*** | (2006.01) |

(52) U.S. Cl. ..... 216/88; 438/692

(58) Field of Classification Search ..... 216/88, 216/89, 90, 91; 156/345.1, 345.2, 345.12, 156/345.13, 345.14, 345.15, 345.16, 345.17, 156/345.23; 451/287, 288, 289; 438/691, 438/692, 690, 694

See application file for complete search history.

(56) References Cited

U.S. PATENT DOCUMENTS

| | | | |
|---|---|---|---|
| 5,232,875 | A | 8/1993 | Tuttle et al. |
| 5,302,233 | A | 4/1994 | Kim et al. |
| 5,314,843 | A | 5/1994 | Yu et al. |
| 5,434,107 | A | 7/1995 | Paranjpe |
| 5,533,924 | A | 7/1996 | Stroupe et al. |
| 5,554,065 | A | 9/1996 | Clover |
| 5,569,062 | A | 10/1996 | Karlsrud |
| 5,575,707 | A | 11/1996 | Talieh et al. |
| 5,618,381 | A | 4/1997 | Doan et al. |
| 5,624,299 | A | 4/1997 | Shendon |
| 5,624,300 | A | 4/1997 | Kishii et al. |
| 5,624,303 | A | 4/1997 | Robinson |
| 5,624,304 | A | 4/1997 | Pasch et al. |
| 5,639,697 | A | 6/1997 | Weling et al. |
| 5,643,046 | A | 7/1997 | Katakabe et al. |
| 5,643,050 | A | 7/1997 | Chen |
| 5,643,406 | A | 7/1997 | Shimomura et al. |

(Continued)

FOREIGN PATENT DOCUMENTS

| | | | |
|---|---|---|---|
| EP | 0683511 | A2 | 11/1995 |

*Primary Examiner*—Parviz Hassanzadeh
*Assistant Examiner*—Roberts Culbert
(74) *Attorney, Agent, or Firm*—TraskBritt

(57) ABSTRACT

An improvement in a polishing apparatus for planarizing substrates comprises a tenacious coating of a low-adhesion material to the platen surface. An expendable polishing pad is adhesively attached to the low-adhesion material, and may be removed for periodic replacement at much reduced expenditure of force. Polishing pads joined to low-adhesion materials such as polytetrafluoroethylene (PTFE) by conventional adhesives resist distortion during polishing but are readily removed for replacement.

92 Claims, 5 Drawing Sheets

U.S. PATENT DOCUMENTS 5,643,837 A 7/1997 Hayashi
5,743,788 A 4/1998 Vanell
6,036,586 A * 3/2000 Ward ..... 451/287
6,398,905 B1 * 6/2002 Ward ..... 156/345.12
6,814,834 B2 * 11/2004 Ward ..... 156/345.12

* cited by examiner

METHOD FOR REDUCING REMOVAL FORCES FOR CMP PADS

CROSS-REFERENCE TO RELATED APPLICATIONS

This application is a continuation of application Ser. No. 10/160,528, filed May 31, 2002, now U.S. Pat. No. 6,814,834, which is a continuation of application Ser. No. 09/478,692, filed Jan. 6, 2000, now U.S. Pat. No. 6,398,905, issued Jun. 4, 2002, which is a continuation of application Ser. No. 09/124,329, filed Jul. 29, 1998, now U.S. Pat. No. 6,036,586, issued Mar. 14, 2000.

BACKGROUND OF THE INVENTION

1. Field of the Invention

This invention relates generally to polishing methods and apparatus. More particularly, the invention pertains to apparatus and methods for polishing and planarizing semiconductor wafers, optical lenses and the like.

2. State of the Art

In the manufacture of semiconductor devices, it is important that the surface of a semiconductor wafer be planar.

For high density semiconductor devices having features with extremely small sizes, i.e. less than 1 $\mu$m, planarity of the semiconductor wafer is particularly critical to the photolithographic forming of the extremely small conductive traces and the like.

Methods currently used for planarization include (a) reflow planarization, (b) application of a sacrificial dielectric followed by etch back planarization, (c) mechanical polishing and (d) chemical-mechanical polishing (CMP). Methods (a) through (c) have some applications but have disadvantages for global wafer planarization, particularly when fabricating dense, high speed devices.

In U.S. Pat. No. 5,434,107 of Paranjpe, a planarization method consists of applying an interlevel film of dielectric material to a wafer—and subjecting the wafer to heat and pressure so that the film flows and fills depressions in the wafer, producing a planar wafer surface. An ultraflat member overlying the dielectric material ensures that the latter forms a flat surface as it hardens. The ultraflat member has a non-stick surface such as polytetrafluoroethylene so that the interlevel film does not adhere thereto.

In a similar method shown in European Patent Publication No. 0 683 511 A2 of Prybyla et al. (AT&T Corp.), a wafer is covered with a hardenable low-viscosity polymer and an object with a highly planar surface is placed in contact with the polymer until the polymer is cured. The object is separated from the polymer, which has cured into a highly planar surface.

The planarization method of choice for fabrication of dense integrated circuits is typically chemical-mechanical polishing (CMP). This process comprises the abrasive polishing of the semiconductor wafer surface in the presence of a liquid or slurry.

In one form of CMP, a slurry of an abrasive material, usually combined with a chemical etchant at an acidic or alkaline pH, polishes the wafer surface in moving compressed planar contact with a relatively soft polishing pad or fabric. The combination of chemical and mechanical removal of material during polishing results in superior planarization of the polished surface. In this process it is important to remove sufficient material to provide a smooth surface, without removing an excessive quantity of underlying materials such as metal leads. It is also important to avoid the uneven removal of materials having different resistances to chemical etching and abrasion.

In an alternative CMP method, the polishing pad itself includes an abrasive material, and the added "slurry" may contain little or no abrasive material, but is chemically composed to provide the desired etching of the surface. This method is disclosed in U.S. Pat. No. 5,624,303 of Robinson, for example.

Various methods for improving wafer planarity are directed toward the application of interlayer materials of various hardness on the wafer surface prior to polishing. Such methods are illustrated in U.S. Pat. No. 5,618,381 of Doan et al., U.S. Pat. No. 5,639,697 of Weling et al., U.S. Pat. No. 5,302,233 of Kim et al., U.S. Pat. No. 5,643,837 of Hayashi, and U.S. Pat. No. 5,314,843 of Yu et al.

The typical apparatus for CMP polishing of a wafer comprises a frame or base on which a rotatable polishing pad holder or platen is mounted. The platen, for example, may be about 20–48 inches (about 50–122 cm.) or more in diameter. A polishing pad is typically joined to the platen surface with a pressure-sensitive adhesive (PSA).

One or more rotatable substrate carriers are configured to compress e.g. semiconductor wafers against the polishing pad. The substrate carrier may include non-stick portions to ensure that the substrate, e.g. wafer, is released after the polishing step. Such is shown in U.S. Pat. No. 5,434,107 of Paranjpe and U.S. Pat. No. 5,533,924 of Stroupe et al.

The relative motion, whether circular, orbital or vibratory, of the polishing pad and substrate in an abrasive/etching slurry may provide a high degree of planarity without scratching or gouging of the substrate surface, depending upon wafer surface conditions. Variations in CMP apparatus are shown in U.S. Pat. No. 5,232,875 of Tuttle et al., U.S. Pat. No. 5,575,707 of Talieh et al., U.S. Pat. No. 5,624,299 of Shendon, U.S. Pat. No. 5,624,300 of Kishii et al., U.S. Pat. No. 5,643,046 of Katakabe et al., U.S. Pat. No. 5,643,050 of Chen, and U.S. Pat. No. 5,643,406 of Shimomura et al.

In U.S. Pat. No. 5,575,707 of Talieh et al., a wafer polishing system has a plurality of small polishing pads which together are used to polish a semiconductor wafer.

As shown in U.S. Pat. No. 5,624,304 of Pasch et al., the polishing pad may be formed in several layers, and a circumferential lip may be used to retain a desired depth of slurry on the polishing surface.

A CMP polishing pad has one or more layers and may comprise, for example, felt fiber fabric impregnated with blown polyurethane. Other materials may be used to form suitable polishing pads. In general, the polishing pad is configured as a compromise polishing pad—that is a pad having sufficient rigidity to provide the desired planarity, and sufficient resilience to obtain the desired continuous tactile pressure between the pad and the substrate as the substrate thickness decreases during the polishing process.

Polishing pads are subjected to stress forces in directions both parallel to and normal to the pad-substrate interfacial surface. In addition, pad deterioration may occur because of the harsh chemical environment. Thus, the adhesion strength of the polishing pad to the platen must be adequate to resist the applied multidirectional forces during polishing, and chemical deterioration should not be so great that the pad-to-platen adhesion fails before the pad itself is in need of replacement.

Pores or depressions in pads typically become filled with abrasive materials during the polishing process. The resulting "glaze" may cause gouging of the surface being polished. Attempts to devise apparatus and "pad conditioning"

methods for removing such "glaze" materials are illustrated in U.S. Pat. No. 5,569,062 of Karlsrud and U.S. Pat. No. 5,554,065 of Clover.

In any case, polishing pads are expendable, having a limited life and requiring replacement on a regular basis, even in a system with pad conditioning apparatus. For example, the working life of a typical widely used CMP polishing pad is about 20–30 hours.

Replacement of polishing pads is a difficult procedure. The pad must be manually pulled from the platen, overcoming the tenacity of the adhesive which is used. The force required to manually remove a 30-inch diameter pad from a bare aluminum or ceramic platen may exceed 100 lbf (444.8 Newtons) and may be as high as 150 lbf (667.2 Newtons) or higher. Manually applying such high forces may result in personal injury as well as damage to the platen and attached machinery.

BRIEF SUMMARY OF THE INVENTION

The invention comprises the application of a permanent, low adhesion, i.e. "non-stick," coating of uniform thickness to the platen surface. Exemplary of such coating materials are fluorinated compounds, in particular fluoropolymers including polytetrafluoroethylene (PTFE) sold under the trademark TEFLON by DuPont, as well as polymonochlorotrifluoroethylene (CTFE) and polyvinylidene fluoride ($PVF_2$). The coating retains its tenacity to the underlying platen material, and its relatively low adhesion to other materials, at the temperatures, mechanical forces, and chemical action encountered in CMP processes.

BRIEF DESCRIPTION OF THE SEVERAL VIEWS OF THE DRAWINGS

The invention is illustrated in the following figures, wherein the elements are not necessarily shown to scale.

DETAILED DESCRIPTION OF THE INVENTION

Figure 1:
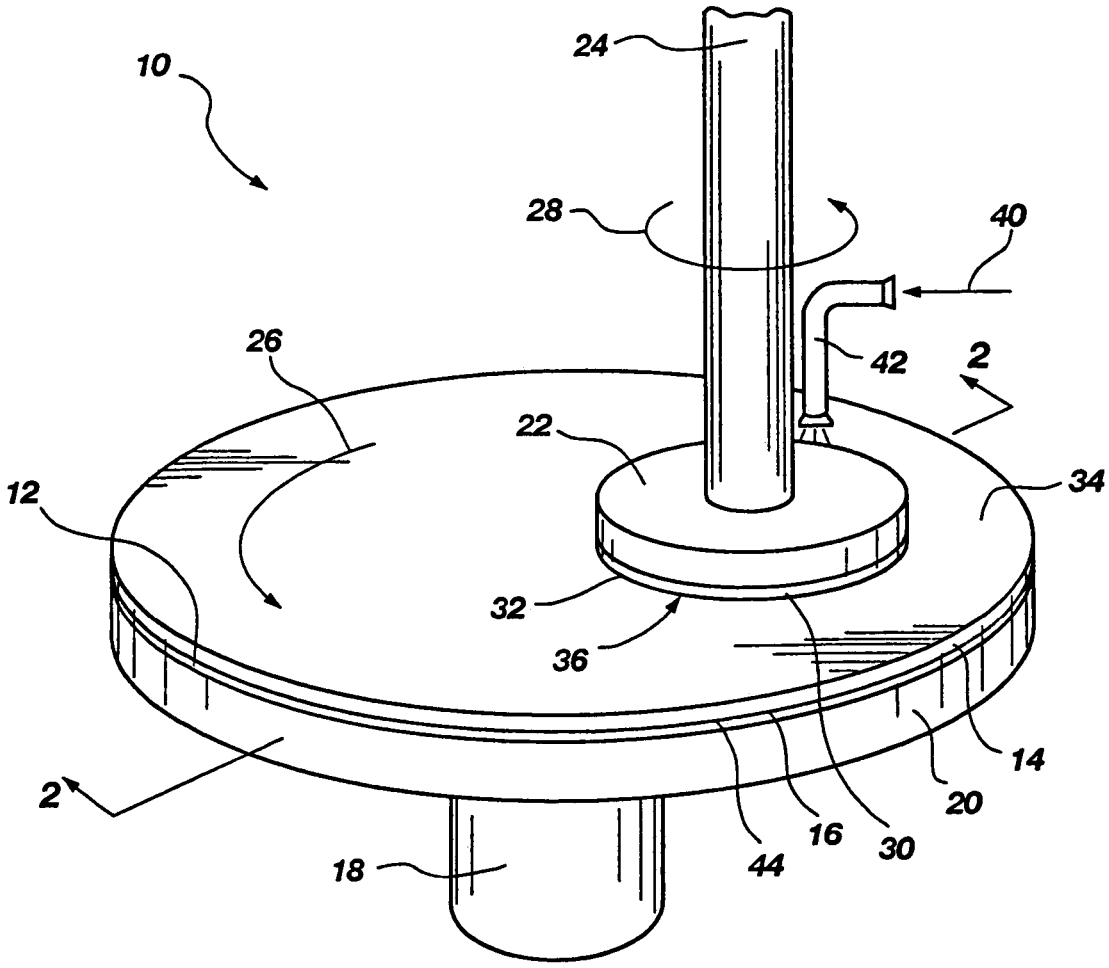
Fig. 1 (PRIOR ART)
FIG. 1 is a perspective partial view of a polishing apparatus of the prior art.
Figure 2:
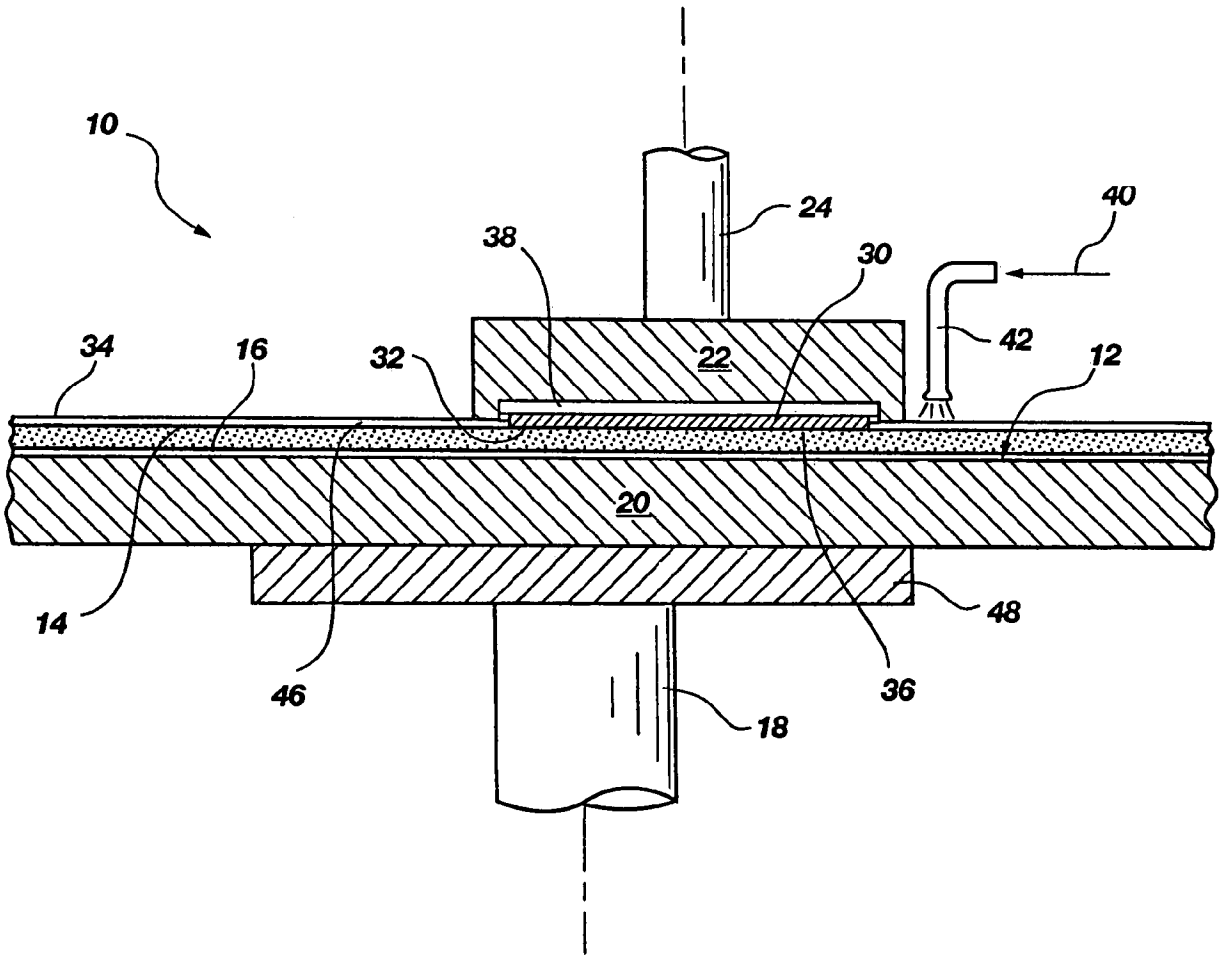
Fig. 2 (PRIOR ART)
FIG. 2 is a cross-sectional view of a portion of a polishing apparatus of the prior art, as taken along line 2—2 of FIG. 1.

Portions of a typical prior art chemical-mechanical polishing (CMP) machine 10 are illustrated in drawing FIGS. 1 and 2. A platen 20 has attached to its upper surface 12 a polishing pad 14 by a layer of adhesive 16. If it is desired to rotate platen 20, its shaft 18, attached to the platen 20 by flange 48, may be turned by a drive mechanism, such as a motor and gear arrangement, not shown.

A substrate 30 such as a semiconductor wafer or optical lens is mounted on a substrate carrier 22 which may be configured to be moved in a rotational, orbital and/or vibratory motion by motive means, not shown, through shaft 24. In a simple system, shafts 18 and 24 may be rotated in directions 26 and 28 as shown. The substrate 30 is held in the carrier 22 by friction, vacuum or other means resulting in quick release following the polishing step. A layer 38 of resilient material may lie between the substrate 30 and carrier 22. The surface 32 of the substrate 30 which is to be planarized faces the polishing surface 34 of the pad 14 and is compressed thereagainst under generally light pressure during relative movement of the platen 20 (and pad 14).

In chemical-mechanical polishing (CMP), a polishing slurry 40 is introduced to the substrate-pad interface 36 to assist in the polishing, cool the interfacial area, and help maintain a uniform rate of material removal from the substrate 30. The slurry may be introduced e.g. via tubes 42 from above, or may be upwardly introduced through apertures, not shown, in the polishing pad 14. Typically, the slurry 40 flows as a layer 46 on the pad polishing surface 34 and overflows to be discarded.

Upward removal of a polishing pad 14 from the platen surface 12 is generally a difficult operation requiring high removal forces. Pad replacement is necessary on a regular basis, and the invention described herein and illustrated in drawing FIGS. 3 through 6 makes pad replacement easier, safer and faster.

Figure 3:
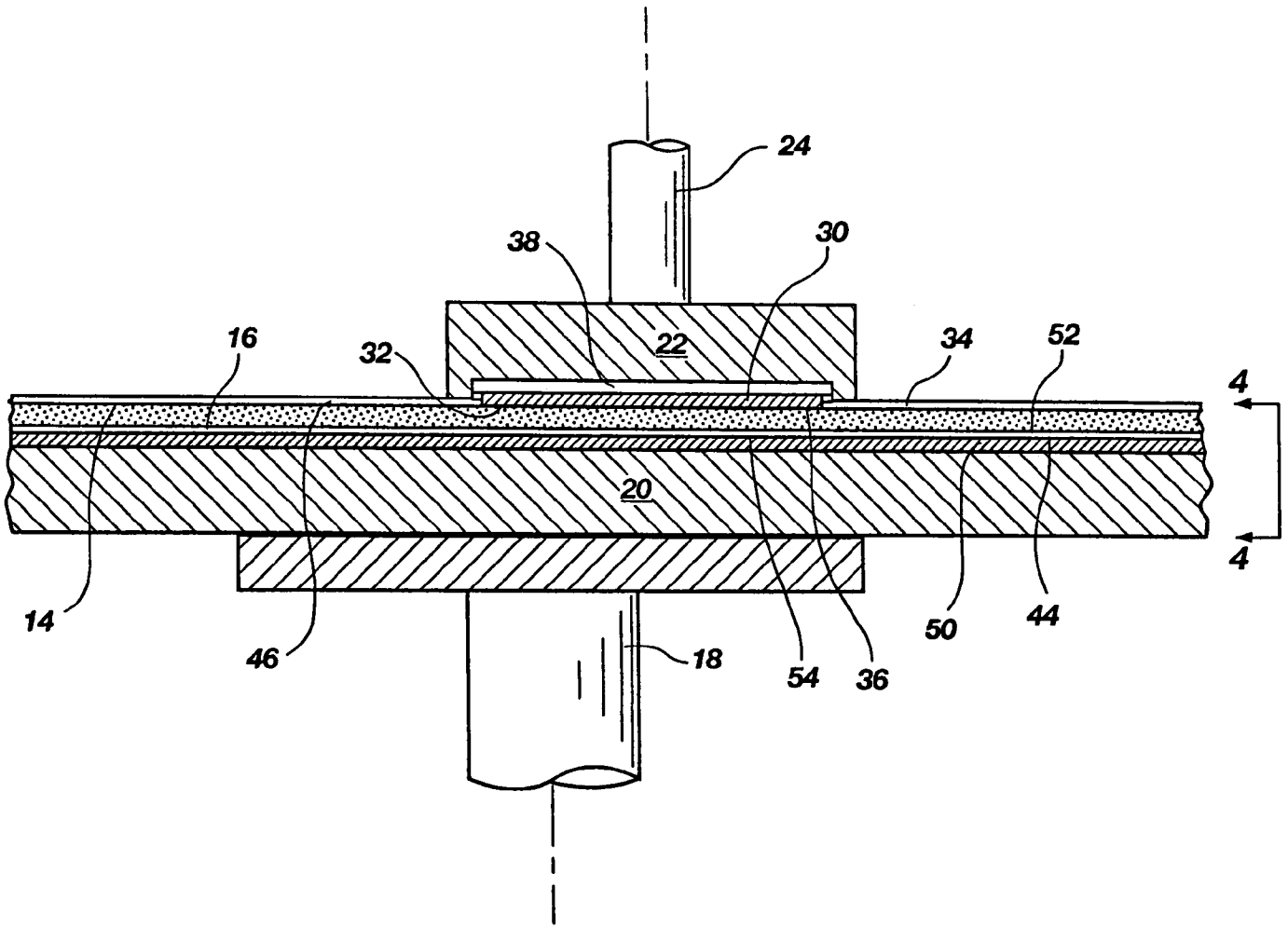
FIG. 3 is a cross-sectional view of a portion of a polishing apparatus of the invention.
Figure 4:
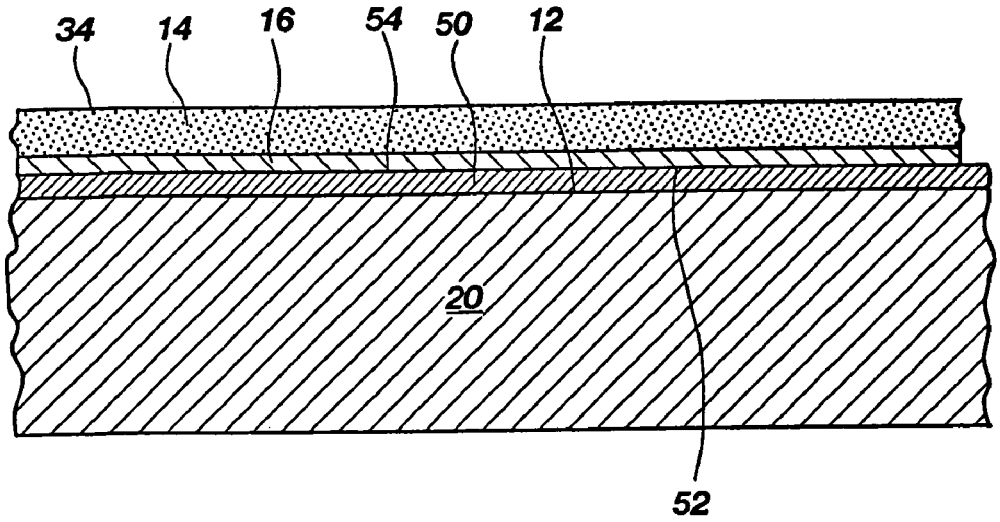
FIG. 4 is a cross-sectional view of a portion of a platen and polishing pad of the invention, as taken along line 4—4 of FIG. 3.

Turning now to drawing FIGS. 3 and 4, the prior art polishing apparatus of drawing FIG. 2 is shown with a platen 20 modified in accordance with the invention. Parts are numbered as in drawing FIG. 2, with the modification comprising a permanent coating 50 of a "non-stick" or low-adhesion material applied to the upper surface 12 of the platen 20, along coating/adhesive interface 54. The polishing pad 14 is then attached to the coating 50 using a pressure-sensitive adhesive (PSA) 16. It is common practice for manufacturers of polishing pads to supply pads with a high-adhesion PSA already fixed to the attachment surface 44 of the pads. It has been found that the adhesion of polishing pads 14 to certain low-adhesion coatings 50 with conventional high adhesion adhesives results in a lower release force, yet the bond strength is sufficient to maintain the integrity of the polishing pads 14 during the polishing operations. Typically, variables affecting the release force include the type and surface smoothness of the coating 50, the type and specific adhesion characteristics of the adhesive material 16, and pad size.

Figure 6:
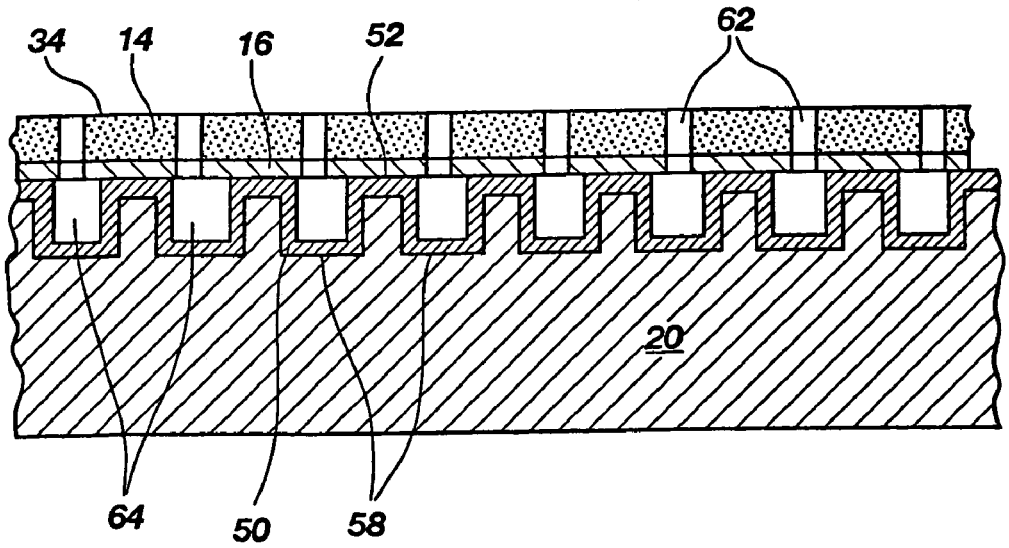
FIG. 6 is a cross-sectional view of a portion of a platen and polishing pad of the invention, as taken along line 6—6 of FIG. 5.
Figure 5:
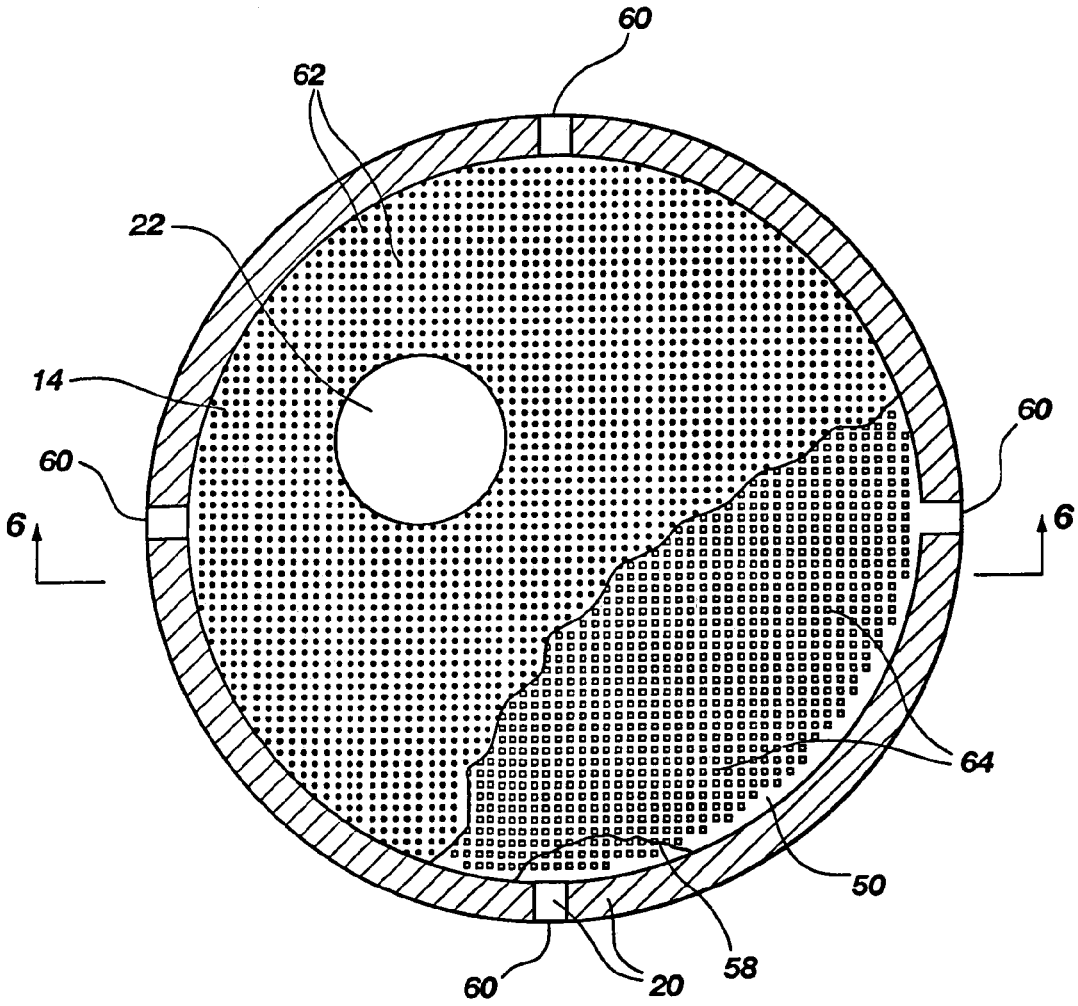
FIG. 5 is a top view of a polishing platen and pad of another embodiment of the invention.

Referring to drawing FIGS. 5 and 6, depicted is another version of the platen 20 which is coated with a low-adhesion coating 50 in accordance with the invention. In this embodiment, the platen 20 includes a network of channels 58, and slurry 40 is fed thereto through conduits 60. The low-adhesion coating 50 covers the platen 20 and, as shown, may extend into at least the upper portions of channels 58. Apertures 64 through the coating 50 match the channels 58 in the platen 20. The polishing pad 14 and attached pressure-sensitive adhesive (PSA) 16 have through-apertures 62 through which the slurry 40 may flow upward from channels 58 and onto the polishing surface 34 of the pad 14.

The surface area of coating 50 to which the adhesive 16 may adhere is reduced by the apertures 64. This loss of contact area between adhesive 16 and platen coating 50 may be compensated by changing the surface smoothness of the coating or using an adhesive material with a higher release force.

Materials which have been found useful for coating the platen 20 include coatings based on fluoropolymers, including polytetrafluoroethylene (PTFE or "Teflon"), polymonochloro-trifluoroethylene (CTFE) and polyvinylidene fluoride ($PVF_2$). Other materials may be used to coat the upper surface 12 of platen 20, provided that the material has the desired adherence, i.e. release properties, with available adhesives, may be readily cleaned, and has a long life in the mechanical and chemical environment of polishing.

Various coating methods may be used. The platen 20 may be coated, for example, using any of the various viable commercial processes, including conventional and electrostatic spraying, hot melt spraying, and cementation.

In the application of one coating process to a modification of the platen 20, the upper surface 12 of the platen is first roughened to enhance adhesion. The coating material 50 is then applied to the upper surface 12 by a wet spraying or dry powder technique, as known in the art. In one variation of the coating process, white-hot metal particles, not shown, are first sprayed onto the uncoated base surface and permitted to cool, and the coating 50 is then applied. The metal particles reinforce the coating 50 of low-adhesion material which is applied to the platen 20.

The result of this invention is a substantial reduction in release force between polishing pad 14 and platen 20 to a level at which the pad may be removed from the platen with minimal effort, yet the planar attachment of the pad to the platen during polishing operations will not be compromised. The particular combination(s) of coating 50 and adhesive material 16 which provide the desired release force may be determined by testing various adhesive formulations with different coatings.

Another method for controlling the release force is the introduction of a controlled degree of "roughness" in the coating surfaces 52 (including surfaces of fluorocarbon materials) for changing the coefficient of friction. The adhesion of an adhesive material 16 to a coating 50 may be thus controlled, irrespective of the pad construction, size or composition.

The use of a coating 50 of the invention provides useful advantages in any process where a polishing pad 14 must be periodically removed from a platen 20. Thus, use of the coating 50 is commercially applicable to any polishing method, whether chemical-mechanical polishing (CMP), chemical polishing (CP) or mechanical polishing (MP), where a polishing pad 14 of any kind is attached to a platen 20.

EXAMPLE

A piece of flat aluminum coated with polytetrafluoroethylene (PTFE) was procured. The particular formulation of PTFE was Malynco 35011 Black Teflon™, applied to the aluminum.

Conventional CMP polishing pad samples were obtained in a size of 3.7×4.2 inches (9.4×10.67 cm.). The area of each pad was 15.54 square inches (100.3 square cm.). These pads were identified as SUBA IV psa 2 adhesive pads and were obtained from Rodel Products Corporation of Scottsdale, Ariz.

The polishing pads included a polyurethane-based pressure-sensitive adhesive (PSA2) on one surface. The pads were placed on the coated aluminum, baked at 53° C. for two hours under slight compression, and cooled for a minimum of 45 minutes, thereby bonding the pads to the PTFE surface.

Samples of the same pad material were similarly adhered to an uncoated aluminum surface of a polishing platen for comparison as test controls.

Tests were conducted to determine the force required to remove each pad from the surface coating and the uncoated surfaces. The average measured removal forces were as follows:

Removal force from Malynco 35011 Black Teflon™ coated aluminum: 1.08 lbf.

Removal force from uncoated aluminum: 11.5 lbf.

Extrapolation to actual production size platens of 30 inch diameter indicates that pad removal forces may be reduced from about 100–150 lbf. (about 444.8–667.2 Newtons) to about 15 lbf. to about 25 lbf. (about 66 to 112 Newtons). This force is sufficient to maintain pad-to-platen integrity during long-term polishing but is a significant reduction in the force required for pad removal and replacement.

It is apparent to those skilled in the art that various changes and modifications, including variations in pad type and size, platen type and size, pad removal procedure, etc. may be made to the polishing apparatus and method of the invention as described herein without departing from the spirit and scope of the invention as defined in the following claims.

What is claimed is:

1. A method for polishing at least one wafer using a chemical-mechanical planarization apparatus, the chemical-mechanical planarization apparatus having a polishing pad having an attachment surface for attaching the polishing pad to a portion of the chemical-mechanical planarization apparatus and having a polishing surface for planarizing a surface of the at least one wafer using a chemical-mechanical planarization process by movement of the polishing pad with respect to the at least one wafer, comprising:

providing a platen having a first surface for adhesive attachment of the attachment surface of the polishing pad thereto, the first surface having at least one channel therein, the platen including a coating of a fluoropolymer material on at least a portion of the first surface thereof for the adhesive attachment of the polishing pad thereto;

providing a carrier for holding the at least one wafer against the polishing surface of the polishing pad;

providing an apparatus for moving the platen and carrier relative to each other for the chemical-mechanical planarization process of at least a portion of the surface of the at least one wafer; and contacting the at least one wafer with the polishing pad attached to the platen during a chemical-mechanical planarization process.

2. The method of claim 1, wherein the fluoropolymer material comprises one of polytetrafluoro-ethylene (TFE), polymonochlorotrifluoroethylene (CTFE) and polyvinylidene fluoride ($PVF_2$).

3. The method of claim 1, wherein the platen comprises one of a metal and a ceramic material.

4. The method of claim 1, wherein the platen comprises an aluminum material.

5. The method of claim 1, wherein the first surface of the platen includes a plurality of channels for slurry flow formed therein.

6. The method of claim 1, further comprising:

an adhesive material joining the attachment surface of the polishing pad to the coating of fluoropolymer material on at least a portion of the platen.

7. A method for a reducing adhesion to a platen used for the planarizing of at least a portion of a surface of a wafer located in a polishing machine used in a chemical-mechanical polishing process of the wafer, the platen used with a polishing pad having an attachment surface and a polishing surface, comprising:

providing a rigid member having a substantially planar first surface having at least one channel therein;

providing a fluoropolymer coating; and coating at least a portion of the rigid member using the fluoropolymer coating for attachment of the attachment surface of the polishing pad using an adhesive material applied to the attachment surface of a polishing pad for attaching at least a portion of the polishing pad to at least a portion of the fluoropolymer coating on the first surface of the rigid member.

8. The method of claim 7, wherein the platen is configured to rotate about an axis normal to the first surface of the rigid member.

9. The method of claim 7, wherein the adhesive material is a pressure-sensitive adhesive material.

10. The method of claim 7, wherein the fluoropolymer coating comprises one of polytetrafluoro-ethylene (TFE), polymonochlorotrifluoroethylene (CTFE) and polyvinylidene fluoride ($PVF_2$).

11. The method of claim 7, wherein the platen has the attachment surface thereof configured for use in the chemical-mechanical polishing process using the polishing pad adhesively attached to the fluoropolymer coating.

12. The method of claim 7, wherein the attachment surface of the platen has a plurality of channels therein for passage of a slurry therethrough, the fluoropolymer coating on the attachment surface of the platen configured for adhesive attachment of a polishing pad having apertures extending therethrough for discharge of the slurry onto the polishing surface.

13. The method of claim 9, wherein the fluoropolymer coating comprises a roughened fluoropolymer coating to enhance adhesion between the fluoropolymer coating and the pressure-sensitive adhesive material.

14. A method for polishing at least one wafer using a chemical-mechanical planarization apparatus comprising:

providing a platen having a first surface for adhesive attachment of an attachment surface of a polishing pad thereto, the first surface having at least one channel therein, the platen including a coating of a fluoropolymer material on at least a portion of the first surface thereof for the adhesive attachment of the polishing pad thereto;

providing a carrier for holding the at least one wafer against a polishing surface of the polishing pad;

providing an apparatus for moving the platen and the carrier relative to each other for the chemical-mechanical planarization process of at least a portion of the surface of the at least one wafer; and contacting the at least one wafer with the polishing pad attached to the platen during the chemical-mechanical planarization process.

15. The method of claim 14, wherein the fluoropolymer material comprises one of polytetrafluoro-ethylene (TFE), polymonochlorotrifluoroethylene (CTFE) and polyvinylidene fluoride ($PVF_2$).

16. The method of claim 14, wherein the platen comprises one of a metal and a ceramic material.

17. The method of claim 14, wherein the platen comprises an aluminum material.

18. The method of claim 14, wherein the first surface of the platen includes a plurality of channels for slurry flow formed therein.

19. The method of claim 14, further comprising:

an adhesive material joining the attachment surface of the polishing pad to the coating of fluoropolymer material on at least a portion of the platen.

20. A method for removing a polishing pad from a platen having a substantially planar first surface having at least one channel therein used for planarizing of at least a portion of a surface of a wafer located in a polishing machine used in a chemical-mechanical polishing process of the wafer, the platen used with a polishing pad having an attachment surface and a polishing surface, comprising:

coating at least a portion of the substantially planar first surface of the platen using a fluoropolymer coating for attachment of the attachment surface of the polishing pad using an adhesive material applied to the attachment surface of the polishing pad for attaching at least a portion of the polishing pad to at least a portion of the fluoropolymer coating on the substantially planar first surface of the platen;

adhesively attaching the polishing pad to the first surface of the platen; and removing the polishing pad from the first surface of the platen.

21. The method of claim 20, wherein the platen is configured to rotate about an axis normal to the substantially planar first surface.

22. The method of claim 20, wherein the adhesive material is a pressure-sensitive adhesive material.

23. The method of claim 20, wherein the fluoropolymer coating comprises one of polytetrafluoro-ethylene (TFE), polymonochlorotrifluoroethylene (CTFE) and polyvinylidene fluoride ($PVF_2$).

24. The method of claim 20, wherein the platen has the substantially planar first surface thereof configured for use in the chemical-mechanical polishing process using the polishing pad adhesively attached to the fluoropolymer coating.

25. The method of claim 20, wherein the substantially planar first surface of the platen has a plurality of channels therein for passage of a slurry therethrough, the fluoropolymer coating on the substantially planar first surface of the platen configured for adhesive attachment of the polishing pad having apertures extending therethrough for discharge of the slurry onto the polishing surface.

26. The method of claim 22, wherein the fluoropolymer coating comprises a roughened fluoropolymer coating to enhance adhesion between the fluoropolymer coating and the pressure-sensitive adhesive material.

27. A method for polishing at least one wafer using a chemical-mechanical planarization apparatus having a platen having a first surface for adhesive attachment of an attachment surface of a polishing pad thereto, the first surface having at least one channel therein, having a carrier for holding the at least one wafer against a polishing surface of the polishing pad, and having an apparatus for moving the platen and the carrier relative to each other for chemical-mechanical planarization process of at least a portion of a surface of the at least one wafer comprising:

coating a fluoropolymer material on at least a portion of the first surface of the platen thereof for the attachment of the polishing pad thereto;

attaching the polishing pad to the platen for the polishing the at least one wafer; and contacting the at least one wafer with the polishing pad attached to the platen during a chemical-mechanical planarization process.

28. The method of claim 27, wherein the fluoropolymer material comprises one of polytetrafluoro-ethylene (TFE), polymonochlorotrifluoroethylene (CTFE) and polyvinylidene fluoride ($PVF_2$).

29. The method of claim 27, wherein the platen comprises one of a metal and a ceramic material.

30. The method of claim 27, wherein the platen comprises an aluminum material.

31. The method of claim 27, wherein the first surface of the platen includes a plurality of channels for slurry flow formed therein.

32. The method of claim 27, further comprising:

an adhesive material joining the attachment surface of the polishing pad to the coating of fluoropolymer material on at least a portion of the platen.

33. A replacement method for replacing a polishing pad on a platen having a substantially planar first surface having at least one channel therein used for planarizing of at least a portion of a surface of a wafer located in a polishing machine used in a chemical-mechanical polishing process of the wafer, the platen used with the polishing pad having an attachment surface and a polishing surface, comprising:

coating at least a portion of the substantially planar first surface of the platen using a fluoropolymer coating for attachment of the attachment surface of the polishing pad using an adhesive material applied to the attachment surface of the polishing pad for attaching at least a portion of the polishing pad to at least a portion of the fluoropolymer coating on the substantially planar first surface of the platen;

adhesively attaching the polishing pad to the substantially planar first surface of the platen; and removing the polishing pad from the substantially planar first surface of the platen.

34. The method of claim 33, wherein the platen is configured to rotate about an axis normal to the substantially planar first surface.

35. The method of claim 33, wherein the adhesive material is a pressure-sensitive adhesive material.

36. The method of claim 33, wherein the fluoropolymer coating comprises one of polytetrafluoro-ethylene (TFE), polymonochlorotrifluoroethylene (CTFE) and polyvinylidene fluoride ($PVF_2$).

37. The method of claim 33, wherein the platen has the substantially planar first surface thereof configured for use in the chemical-mechanical polishing process using the polishing pad adhesively attached to the fluoropolymer coating.

38. The method of claim 33, wherein the substantially planar first surface of the platen has a plurality of channels therein for passage of a slurry therethrough, the fluoropolymer coating on the substantially planar first surface of the platen configured for adhesive attachment of the polishing pad having apertures extending therethrough for discharge of the slurry onto the polishing surface.

39. The method of claim 35, wherein the fluoropolymer coating comprises a roughened fluoropolymer coating to enhance adhesion between the fluoropolymer coating and the pressure-sensitive adhesive material.

40. A method of planarizing at least a portion of a wafer in a polishing apparatus having a platen having a substantially planar first surface having at least one channel therein used for the planarizing of at least a portion of a surface of the wafer in a chemical-mechanical polishing process of the wafer, the platen having a polishing pad having an attachment surface and a polishing surface, comprising:

using a platen having a fluoropolymer coating on at least a portion of the substantially planar first surface of the platen for attachment of the attachment surface of the polishing pad; and adhesively attaching the attachment surface of the polishing pad to the substantially planar first surface of the platen using an adhesive material.

41. The method of claim 40, wherein the platen is configured to rotate about an axis normal to the substantially planar first surface.

42. The method of claim 40, wherein the adhesive material is a pressure-sensitive adhesive material.

43. The method of claim 40, wherein the fluoropolymer coating comprises one of polytetrafluoro-ethylene (TFE), polymonochlorotrifluoroethylene (CTFE) and polyvinylidene fluoride ($PVF_2$).

44. The method of claim 40, wherein the platen has the substantially planar first surface thereof configured for use in the chemical-mechanical polishing process using the polishing pad adhesively attached to the fluoropolymer coating.

45. The method of claim 40, wherein the substantially planar first surface of the platen has a plurality of channels therein for passage of a slurry therethrough, the fluoropolymer coating on the substantially planar first surface of the platen configured for adhesive attachment of the polishing pad having apertures extending therethrough for discharge of the slurry onto the polishing surface.

46. The method of claim 42, wherein the fluoropolymer coating comprises a roughened fluoropolymer coating to enhance adhesion between the fluoropolymer coating and the pressure-sensitive adhesive material.

47. A planarization method for at least one wafer using a chemical-mechanical planarization apparatus having a platen having a first surface for adhesive attachment of an attachment surface of a polishing pad thereto, the first surface having at least one channel therein, having a carrier for holding the at least one wafer against a polishing surface of the polishing pad, and having an apparatus for moving the platen and the carrier relative to each other for chemical-mechanical planarization process of at least a portion of a surface of the at least one wafer comprising:

using a fluoropolymer material on at least a portion of the first surface of the platen for attachment of the polishing pad thereto;

attaching the polishing pad to the platen for the polishing of the at least one wafer; and contacting the at least one wafer with the polishing pad attached to the platen during a chemical-mechanical planarization process.

48. The method of claim 47, wherein the fluoropolymer material comprises one of polytetrafluoro-ethylene (TFE), polymonochlorotrifluoroethylene (CTFE) and polyvinylidene fluoride ($PVF_2$).

49. The method of claim 47, wherein the platen comprises one of a metal and a ceramic material.

50. The method of claim 47, wherein the platen comprises an aluminum material.

51. The method of claim 47, wherein the first surface of the platen includes a plurality of channels for slurry flow formed therein.

52. The method of claim 47, further comprising:

an adhesive material joining the attachment surface of the polishing pad to the coating of fluoropolymer material on at least a portion of the platen.

53. A method for attaching a polishing pad on a platen having a substantially planar first surface having at least one channel therein used for a chemical-mechanical polishing process for at least a portion of a surface of a wafer located in an apparatus, the platen used with a polishing pad having an attachment surface and a polishing surface, comprising:

coating at least a portion of the substantially planar first surface of the platen using a fluoropolymer coating for attachment of the attachment surface of the polishing pad using an adhesive material applied to the attachment surface of the polishing pad for attaching at least a portion of the polishing pad to at least a portion of the fluoropolymer coating on the substantially planar first surface of the platen;

adhesively attaching a polishing pad to the substantially planar first surface of the platen; and removing the polishing pad from the substantially planar first surface of the platen.

54. The method of claim 53, wherein the platen is configured to rotate about an axis normal to the substantially planar first surface.

55. The method of claim 53, wherein the adhesive material is a pressure-sensitive adhesive material.

56. The method of claim 53, wherein the fluoropolymer coating comprises one of polytetrafluoro-ethylene (TFE), polymonochlorotrifluoroethylene (CTFE) and polyvinylidene fluoride ($PVF_2$).

57. The method of claim 53, wherein the platen has the substantially planar first surface thereof configured for use in the chemical-mechanical polishing process using the polishing pad adhesively attached to the fluoropolymer coating.

58. The method of claim 53, wherein the substantially planar first surface of the platen has a plurality of channels therein for passage of a slurry therethrough, the fluoropolymer coating on the substantially planar first surface of the platen configured for adhesive attachment of the polishing pad having apertures extending therethrough for discharge of the slurry onto the polishing surface.

59. The method of claim 55, wherein the fluoropolymer coating comprises a roughened fluoropolymer coating to enhance adhesion between the fluoropolymer coating and the pressure-sensitive adhesive material.

60. A method for attaching a polishing pad on a platen having a substantially planar first surface having at least one channel therein used for a chemical-mechanical polishing process for at least a portion of a surface of a wafer located in an apparatus, the platen used with a polishing pad having an attachment surface and a polishing surface, comprising:

using a fluoropolymer coating on at least a portion of the substantially planar first surface of the platen for attachment of the attachment surface of the polishing pad; and adhesively attaching the attachment surface of the polishing pad to the substantially planar first surface of the platen using an adhesive material.

61. The method of claim 60, further comprising:

removing the polishing pad from the first surface of the platen.

62. The method of claim 60, wherein the adhesive material is a pressure-sensitive adhesive material.

63. The method of claim 60, wherein the fluoropolymer coating comprises one of polytetrafluoro-ethylene (TFE), polymonochlorotrifluoroethylene (CTFE) and polyvinylidene fluoride ($PVF_2$).

64. The method of claim 60, wherein the platen has the substantially planar first surface thereof configured for use in the chemical-mechanical polishing process using the polishing pad adhesively attached to the fluoropolymer coating.

65. The method of claim 60, wherein the substantially planar first surface of the platen has a plurality of channels therein for passage of a slurry therethrough, the fluoropolymer coating on the substantially planar first surface of the platen configured for adhesive attachment of a polishing pad having apertures extending therethrough for discharge of the slurry onto the polishing surface.

66. The method of claim 62, wherein the fluoropolymer coating comprises a roughened fluoropolymer coating to enhance adhesion between the fluoropolymer coating and the pressure-sensitive adhesive material.

67. A method for attaching a polishing pad on a platen having a substantially planar first surface having at least one channel therein used for a chemical-mechanical polishing process for at least a portion of a surface of a wafer located in an apparatus, the platen used with a polishing pad having an attachment surface and a polishing surface, comprising:

providing a platen having floropolymer coating on at least a portion of the substantially planar first surface of the platen for attachment of the attachment surface of the polishing pad; and adhesively attaching a polishing pad to the substantially planar first surface of the platen using an adhesive material.

68. The method of claim 67, further comprising:

removing the polishing pad from the substantially planar first surface of the platen.

69. The method of claim 67, wherein the adhesive material is a pressure-sensitive adhesive material.

70. The method of claim 67, wherein the fluoropolymer coating comprises one of polytetrafluoro-ethylene (TFE), polymonochlorotrifluoroethylene (CTFE) and polyvinylidene fluoride ($PVF_2$).

71. The method of claim 67, wherein the platen has the substantially planar first surface thereof configured for use in the chemical-mechanical polishing process using the polishing pad adhesively attached to the fluoropolymer coating.

72. The method of claim 67, wherein the substantially planar first surface of the platen has a plurality of channels therein for passage of a slurry therethrough, the fluoropolymer coating on the substantially planar first surface of the platen configured for adhesive attachment of a polishing pad having apertures extending therethrough for discharge of the slurry onto the polishing surface.

73. The method of claim 67, wherein the fluoropolymer coating comprises a roughened fluoropolymer coating to enhance adhesion between the fluoropolymer coating and a pressure-sensitive adhesive material.

74. A method for modifying a polishing apparatus having a platen having a substantially planar first surface having at least one channel therein used for a chemical-mechanical polishing process for at least a portion of a surface of a wafer located in the polishing apparatus, comprising:

coating at least a portion of the substantially planar first surface of the platen using a fluoropolymer coating for attachment of an attachment surface of a polishing pad to at least a portion of the substantially planar first surface of the platen using an adhesive material.

75. The method of claim 74, wherein the adhesive material is a pressure-sensitive adhesive material.

76. The method of claim 74, wherein the fluoropolymer coating comprises one of polytetrafluoro-ethylene (TFE), polymonochlorotrifluoroethylene (CTFE) and polyvinylidene fluoride ($PVF_2$).

77. The method of claim 74, wherein the substantially planar first surface of the platen has a plurality of channels therein for passage of a slurry therethrough, the fluoropolymer coating on the substantially planar first surface of the platen configured for attachment of the polishing pad having apertures extending therethrough for discharge of the slurry onto the polishing surface.

78. The method of claim 75, wherein the fluoropolymer coating comprises a roughened fluoropolymer coating to enhance adhesion between the fluoropolymer coating and the pressure-sensitive adhesive material.

79. A method of manufacturing a polishing apparatus having a platen having a substantially planar first surface having at least on channel therein used for a chemical-mechanical polishing process for at least a portion of a surface of a wafer located in the polishing apparatus, comprising:

coating at least a portion of the substantially planar first surface of the platen using a fluoropolymer coating for attachment of an attachment surface of a polishing pad to at least a portion of the first surface of the platen using an adhesive material.

80. The method of claim 79, wherein the fluoropolymer coating comprises one of polytetrafluoro-ethylene (TFE), polymonochlorotrifluoroethylene (CTFE) and polyvinylidene fluoride ($PVF_2$).

81. The method of claim 79, wherein the substantially planar first surface of the platen has a plurality of channels therein for passage of a slurry therethrough, the fluoropolymer coating on the substantially planar first surface of the platen configured for attachment of the polishing pad having apertures extending therethrough for discharge of the slurry onto the polishing surface.

82. The method of claim 79, wherein the fluoropolymer coating comprises a roughened fluoropolymer coating to enhance adhesion between the fluoropolymer coating and a pressure-sensitive adhesive material.

83. A method for modifying a platen having a substantially planar first surface having at least one channel therein used for a chemical-mechanical polishing process for at least a portion of a surface of a wafer located in a polishing apparatus, comprising:

coating at least a portion of the substantially planar first surface of the platen using a fluoropolymer coating for attachment of an attachment surface of a polishing pad to at least a portion of the substantially planar first surface of the platen using an adhesive material.

84. The method of claim 83, wherein the adhesive material is a pressure-sensitive adhesive material.

85. The method of claim 83, wherein the fluoropolymer coating comprises one of polytetrafluoro-ethylene (TFE), polymonochlorotrifluoroethylene (CTFE) and polyvinylidene fluoride ($PVF_2$).

86. The method of claim 83, wherein the substantially planar first surface of the platen has a plurality of channels therein for passage of a slurry therethrough, the fluoropolymer coating on the substantially planar first surface of the platen configured for attachment of the polishing pad having apertures extending therethrough for discharge of the slurry onto the polishing surface.

87. The method of claim 84, wherein the fluoropolymer coating comprises a roughened fluoropolymer coating to enhance adhesion between the fluoropolymer coating and the pressure-sensitive adhesive material.

88. A method for manufacturing a platen having a substantially planar first surface having at least one channel therein used for a chemical-mechanical polishing process for at least a portion of a surface of a wafer located in a polishing apparatus, comprising:

coating at least a portion of the substantially planar first surface of the platen using a fluoropolymer coating for attachment of an attachment surface of a polishing pad to at least a portion of the first surface of the platen using an adhesive material.

89. The method of claim 88, wherein the adhesive material is a pressure-sensitive adhesive material.

90. The method of claim 88, wherein the fluoropolymer coating comprises one of polytetrafluoro-ethylene (TFE), polymonochlorotrifluoroethylene (CTFE) and polyvinylidene fluoride ($PVF_2$).

91. The method of claim 88, wherein the substantially planar first surface of the platen has a plurality of channels therein for passage of a slurry therethrough, the fluoropolymer coating on the substantially planar first surface of the platen configured for attachment of the polishing pad having apertures extending therethrough for discharge of the slurry onto the polishing surface.

92. The method of claim 89, wherein the fluoropolymer coating comprises a roughened fluoropolymer coating to enhance adhesion between the fluoropolymer coating and the pressure-sensitive adhesive material.

* * * * *